US009098028B2

(12) United States Patent
Takatsuka

(10) Patent No.: US 9,098,028 B2
(45) Date of Patent: Aug. 4, 2015

(54) IMAGE FORMING APPARATUS

(71) Applicant: Oki Data Corporation, Tokyo (JP)

(72) Inventor: Ryo Takatsuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 17 days.

(21) Appl. No.: 13/903,156

(22) Filed: May 28, 2013

(65) Prior Publication Data

US 2013/0322906 A1 Dec. 5, 2013

(30) Foreign Application Priority Data

May 31, 2012 (JP) ..... 2012-124427

(51) Int. Cl.
*G03G 15/20* (2006.01)

(52) U.S. Cl.
CPC ..... *G03G 15/2039* (2013.01); *G03G 15/2078* (2013.01); *G03G 2215/2022* (2013.01); *G03G 2215/2083* (2013.01)

(58) Field of Classification Search
CPC ..... G03G 15/2039; G03G 15/2078; G03G 2215/2077
USPC ..... 399/69, 337
See application file for complete search history.

(56) References Cited

U.S. PATENT DOCUMENTS

| | | | | |
|---|---|---|---|---|
| 6,778,789 | B2 * | 8/2004 | Cho et al. | 399/69 |
| 7,616,910 | B2 * | 11/2009 | Bessho | 399/49 |
| 7,650,092 | B2 * | 1/2010 | Oyumi | 399/38 |
| 8,285,187 | B2 * | 10/2012 | Kimura et al. | 399/341 |
| 2010/0329717 | A1 * | 12/2010 | Yoshioka | 399/68 |
| 2012/0114354 | A1 * | 5/2012 | Saito et al. | 399/67 |
| 2013/0084093 | A1 * | 4/2013 | Namikata | 399/69 |
| 2013/0209127 | A1 * | 8/2013 | Fujimoto et al. | 399/69 |

FOREIGN PATENT DOCUMENTS

JP 2003-255755 A 9/2003

* cited by examiner

*Primary Examiner* — David Gray
*Assistant Examiner* — Carla Therrien
(74) *Attorney, Agent, or Firm* — Muncy, Geissler, Olds & Lowe, P.C.

(57) ABSTRACT

An image forming apparatus includes an image forming part to form a developer image on a recording medium, a fuser part that includes a fuser member and a heat application member to fix the developer image on the recording medium, a heat application control part to control the heat application member so that a temperature of the fuser member falls within a target temperature range that has been set, a temperature setting part to set a first target temperature range and a second target temperature range. The first target temperature range is a target temperature range for a first fusion that is performed on a first surface of the recording medium, and the second target temperature range is another target temperature range, which is lower than the first target temperature range, for a second fusion that is performed on the first surface of the recording medium.

29 Claims, 12 Drawing Sheets

IMAGE FORMING APPARATUS

CROSS REFERENCE TO RELATED APPLICATION

The present application is related to, claims priority from and incorporates by reference Japanese Patent Application No. 2012-124427, filed on May 31, 2012.

TECHNICAL FIELD

The present invention relates to an image forming apparatus, and may be implemented in an electrographic printer, for example.

BACKGROUND

A fuser device that fixes a toner image formed on a print sheet (medium) by heat and pressure is included in an electrographic printer (image forming apparatus) that transfers and fixes the toner image (developer image) of toner (developer) onto the print sheet.

As a conventional image forming apparatus, a fuser device (image heating device) described in JP Laid-Open Patent Application No. 2003-255755 performs duplex printing on a print sheet. However, when the duplex printing and fusion process are performed on the print sheet, conditions to heat during the fusion process on one surface and the other surface may need to be changed. For example, the fuser device described in JP Laid-Open Patent Application No. 2003-255755 performs a first fusion process and a second fusion process, in which the same medium is used, at respective different temperatures to solve disarrangement of an image due to a difference between gloss on a front surface and that on a back surface of the medium as well as re-melting of toner on the front surface during the duplex printing.

A fusion temperature on the front surface is lower than that on the back surface during performing the duplex printing. However, an image can hardly be obtained easily.

An object of the detailed examples disclosed in the present invention is to easily obtain an image.

SUMMARY

One of image forming apparatuses disclosed in the application includes an image forming part configured to form a developer image on a recording medium, a fuser part that includes a fuser member and a heat application member and that is configured to fix the developer image on the recording medium, a heat application control part configured to control the heat application member so that a temperature of the fuser member falls within a target temperature range that has been set; and, a temperature setting part configured to set a first target temperature range and a second target temperature range. The first target temperature range is a target temperature range for a first fusion that is performed on a first surface of the recording medium, and the second target temperature range is another target temperature range, which is lower than the first target temperature range, for a second fusion that is performed on the first surface of the recording medium.

In another view, an image forming apparatus disclosed in the application includes an image forming part configured to form a single color developer image and a multi-color developer image on a recording medium, a fuser part that includes a fuser member and a heat application member and is configured to fix the developer image on the recording medium; a heat application control part configured to control the heat application member so that a temperature of the fuser member falls within a target temperature range that has been set; and a temperature setting part configured to set a first target temperature range and a second target temperature range when the single color developer image and the multi-color developer image are layered. The first target temperature range is a target temperature range for a fusion of the multi-color developer image formed on a first surface of the recording medium, and the second target temperature range is another target temperature range, which is lower than the first target temperature, for a fusion of the single color developer image formed on the first surface of the recording medium.

The detailed examples disclosed in the present invention easily obtain an image.

DETAILED DESCRIPTION OF EMBODIMENTS (A) First Embodiment

A first embodiment of an image forming apparatus and a fuser device according to the present invention are explained in detail below with reference to the accompanying drawings.

(A-1) Configuration of First Embodiment

Figure 2:
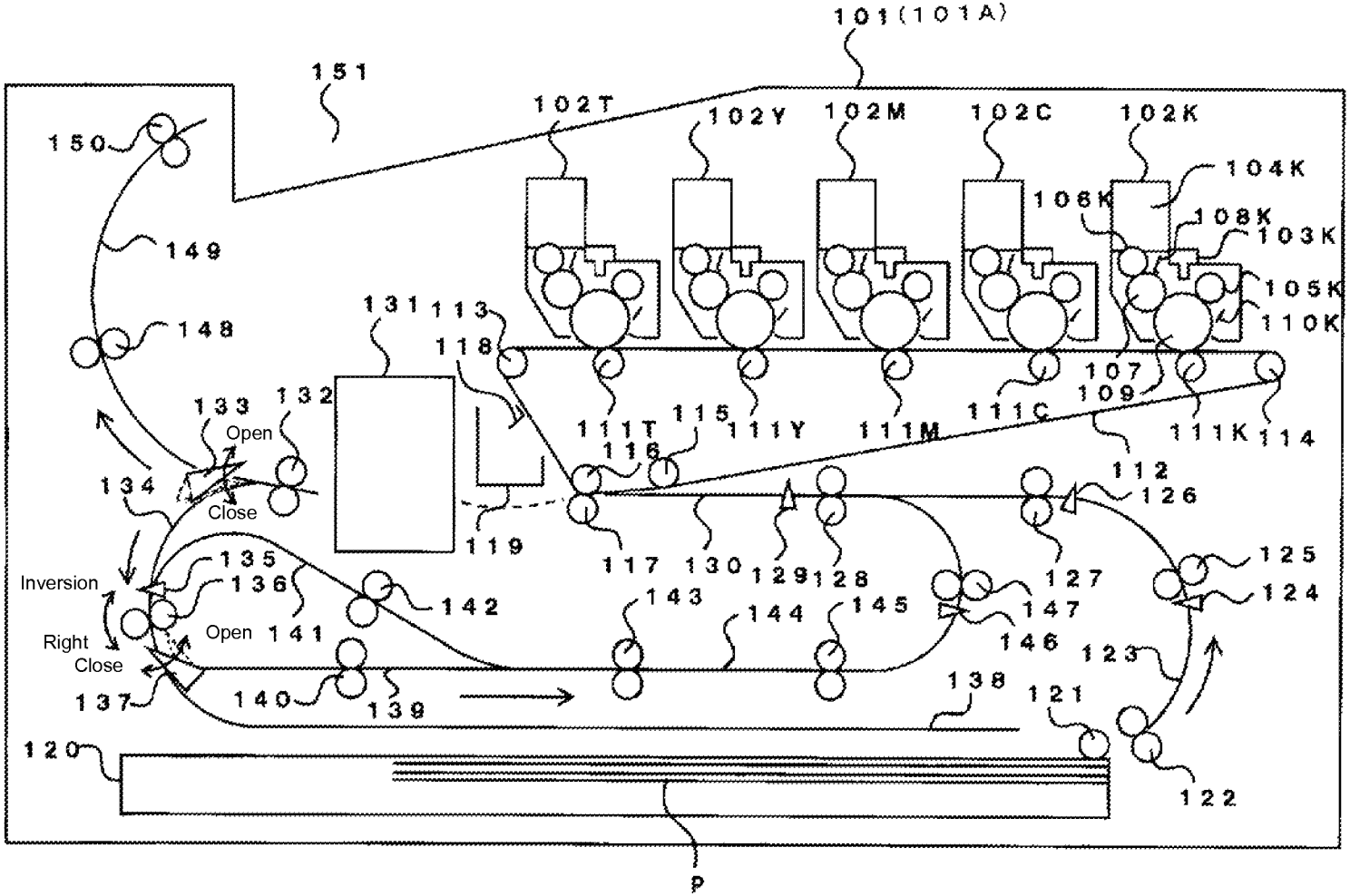
FIG. 2 is a schematic cross-sectional diagram of the image forming apparatus according to the first embodiment.

FIG. 2 is a schematic cross-sectional diagram of an image forming apparatus according to the first embodiment.

As illustrated in FIG. 2, in an image forming apparatus 101, five development units 102 (102K, 102C, 102M, 102Y and 102T), five LED (light emitting diode) heads 103 (103K, 103C, 103M, 103Y and 103T), five primary transfer rollers 111(111K, 111C, 111M, 111Y and 111T), an intermediate transfer belt 112, a drive roller 113, driven rollers 114, 115 and 116, a secondary transfer roller 117, an intermediate transfer cleaning blade 118, a waste toner box 119, a sheet supply cassette 120, a pickup roller 121, a pair of sheet supply rollers 122, a sheet carrying path 123, a registration sensor 124, a pair of registration rollers 125, a pair of carrying rollers 127, a pair of carrying rollers 128, a secondary transfer sensor 129, a sheet carrying path 130, a fuser unit 131, a pair of carrying rollers 132, a duplex separator (DUP separator) 133, a sheet carrying path 134, an inversion sensor 135, inversion rollers 136, a through separator 137, a temporary retreat place 138, a sheet carrying path 139, a pair of carrying rollers 140, a sheet carrying path 141, a pair of carrying rollers 142, a pair of carrying rollers 143, a sheet carrying path 144, a pair of carrying rollers 145, a duplex registration (DUP Reg.) sensor 146, a pair of DUP registration rollers 147, a pair of carrying rollers 148, a sheet carrying path 149, a pair of carrying rollers 150 and a face down stacker 151 are arranged. An image forming part that configures the image forming apparatus of the embodiment includes the development units 102 (102K, 102C, 102M, 102Y and 102T), the LED heads 103 (103K, 103C, 103M, 103Y and 103T), the primary transfer rollers 111 (111K, 111C, 111M, 111Y and 111T), the intermediate transfer belt 112, the drive roller 113, the driven rollers 114, 115 and 116, and the secondary transfer roller 117.

Colors of toner (developer) of the respective development units 102K, 102C, 102M, 102Y and 102T used for development are different. The development units 102K, 102C, 102M, 102Y and 102T performs development using black, cyan, magenta, yellow and transparent toner, respectively. In the present specification, "K" represents black; "C" represents cyan; "M" represents magenta; "Y" represents yellow; and "T" represents transparent. The number of the development units and the colors of the toner used in the image forming apparatus 101 are not limited.

An Internal configuration of each of the development units 102 are the same other than a color of the toner to be used. Therefore, an internal configuration of the development unit 102K is explained below.

The development unit 102K includes a toner cartridge 104, a charge roller 105, a supply roller 106, a development roller 107, a development blade 108, a photosensitive drum 109 and a photosensitive drum cleaning blade 110.

The photosensitive drum 109 forms a toner image on the surface thereof. The toner cartridge 104 contains toner and is removably installed to the development unit 102K. The charge roller 105 uniformly charges the surface of the photosensitive drum. The supply roller 106 supplies the toner contained in the toner cartridge 104 on the development roller 107. The development roller 107 attaches the supplied toner to the surface of the photosensitive drum 109, develops an electrostatic latent image on the surface of the photosensitive drum 109 to form a toner image (developer image) on the surface thereof. The development blade 108 regulates a toner layer on the development roller 107 to a predetermined thickness. The photosensitive drum cleaning blade 110 is a cleaning mechanism that removes the toner that remains on the surface of the photosensitive drum 109 after transfer.

Each of the LED heads 103 (103K, 103C, 103M, 103Y and 103T) irradiates the photosensitive drum 109 of the development unit 102 (102K, 102C, 102M, 102Y and 102T) that corresponds to each LED head 103 with light based on an image signal to form the electrostatic latent image on the surface of the photosensitive drum 109. Each of the primary transfer rollers 111 (111K, 111C, 111M, 111Y and 111T) transfers the toner image in the development unit 102 onto the intermediate transfer belt 112 with an electric field formed by an applied primary transfer bias. The intermediate transfer belt 112 faces the primary transfer rollers 111.

The drive roller 113 drives and rotates the intermediate transfer belt 112. The respective intermediate transfer belt driven rollers 114, 115 and 116 as well as the intermediate transfer belt drive roller 113 stretch the intermediate transfer belt 112.

The secondary transfer roller 117 transfers the toner image formed on the intermediate transfer belt 112 onto a sheet P carried on the sheet carrying path 130 with an electric field formed by an applied secondary transfer bias. The intermediate transfer cleaning blade 118 scrapes off and removes the toner that remains on the secondary transfer roller 117 after transfer.

The waste toner box 119 contains secondary transfer residual toner (waste toner) scraped by the intermediate transfer cleaning blade 118.

The sheet supply cassette 120 stacks and accommodates the sheets P and is removably installed to the image forming apparatus 101.

The pickup roller 121 feeds the sheet P from the sheet supply cassette 120. The pair of sheet supply rollers 122 carries the fed sheet P to the sheet carrying path 123. The registration sensor 124 and the pair of registration rollers 125 perform a skew correction (incline correction) of the sheet P on the sheet carrying path 123.

A carriage sensor 126 detects the sheet P on the sheet carrying path 123. The pair of carrying rollers 127 carries the sheet P on the sheet carrying path 123. The pair of carrying rollers 128 carries the sheet P on the sheet carrying path 130. The secondary transfer sensor (ST sensor) 129 is a sensor that detects that the sheet P is fed on the sheet carrying path 130. The secondary transfer roller 117 is arranged below the sheet carrying path 130.

The fuser unit 131 applies heat and pressure to the sheet P on which the toner image has been transferred by the secondary transfer roller 117 and the intermediate transfer belt 112, and fixes the toner image on the sheet P. Details of a configuration of the fuser unit 131 are discussed later. The sheet P, on which the fusion process has been performed by the fuser unit 131, is carried by the pair of carrying rollers 132.

The DUP separator 133 guides the sheet P carried by the pair of carrying rollers 132 to either the sheet carrying path 149 (ejection side) or the sheet carrying path 134 by an opening and closing operation of a blade thereof. In FIG. 2, a position of the blade of the DUP separator 133 in an open state is illustrated by solid lines and a position thereof in a closed state is illustrated by dotted lines.

The inversion rollers 136 are rollers that perform an inversion operation on the sheet carrying path 134. When images are formed on both sides of the sheet P, the inversion rollers 136 switch back the sheet P here, and carry the sheet P to the sheet carrying path 141 and the pair of carrying rollers 142.

The inversion sensor 135 is a sensor to detect the sheet P on the sheet carrying path 134. The through separator 137 performs either an operation to guide the sheet P to the temporary retreat place 138 (an operation during performing the image formation on the other surface of the sheet P) or an operation to guide the sheet P to the sheet carrying path 139 and the pair of carrying rollers 140 (an operation during performing image formation and fusion on the same surface of the sheet P twice) during the above-discussed switch back operation of the inversion rollers 136 by an opening and closing operation of a blade thereof. In FIG. 2, a position of the blade of the through separator 137 in an open state is illustrated by dotted lines and a position thereof in a closed state is illustrated by solid lines.

The pairs of carrying rollers 143 and 145 carry the sheet P on the sheet carrying path 144.

The face down stacker 151 is an ejection sheet stacker that stacks ejected sheets.

The sheet carrying path 149 is a sheet carrying path immediately in front of the face down stacker 151. The pairs of carrying rollers 148 and 150 carry the sheet P on the sheet carrying path 149.

The DUP registration sensor 146 and the pair of DUP registration rollers 147 perform the skew correction of the sheet P on the sheet carrying path 144.

Figure 3:
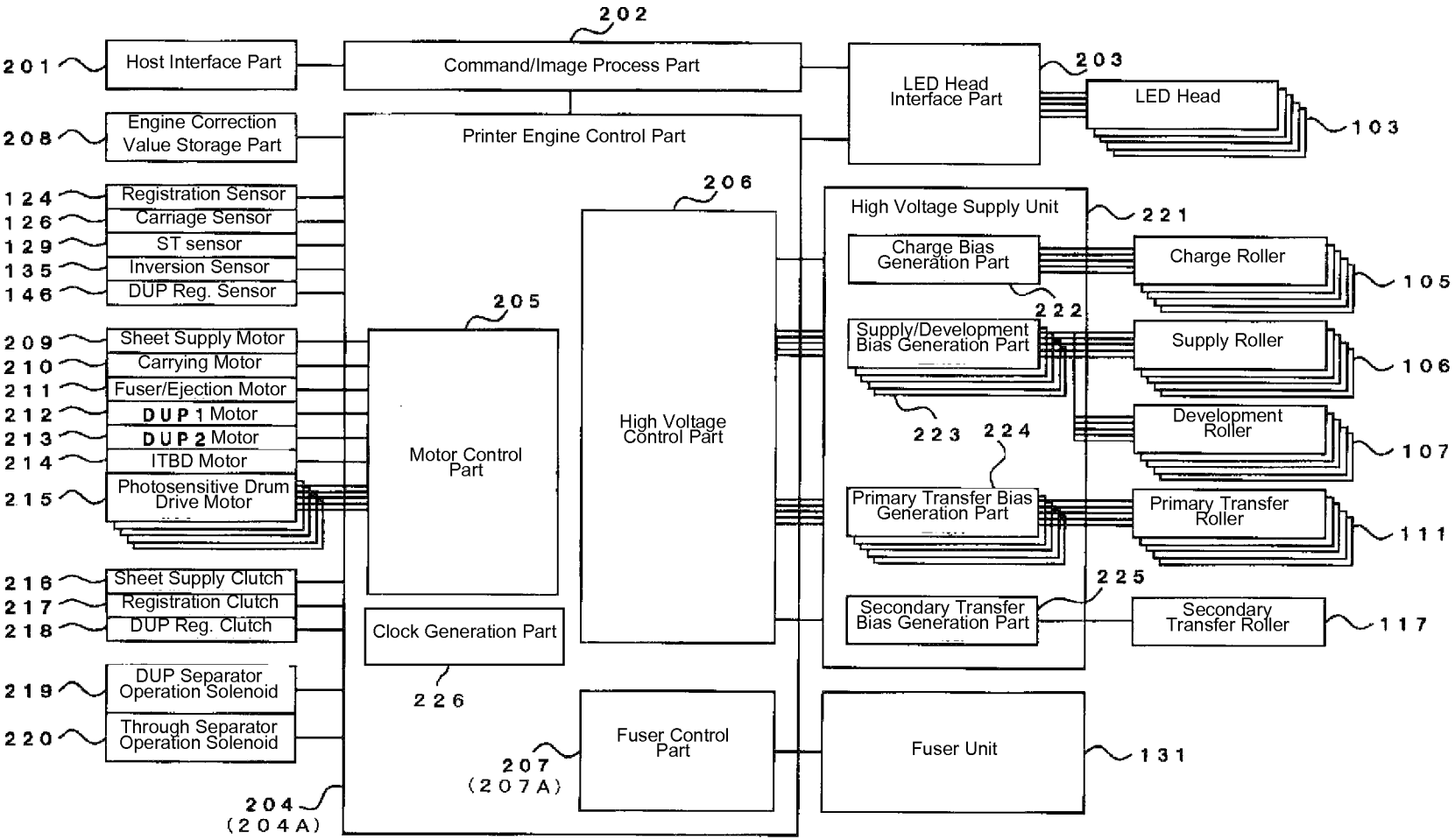
FIG. 3 is a block diagram of a control configuration of each of configuration elements of the image forming apparatus according to the first embodiment.

FIG. 3 is a block diagram of a control configuration of the image forming apparatus. In FIG. 3, the same or corresponding reference numbers are put to parts that are same as or correspond to those in FIG. 2 discussed above.

As illustrated in FIG. 3, the image forming apparatus 101 includes a host interface part 201, a command/image process part 202, an LED head interface part 203, a printer engine control part 204, a sheet supply motor 209, a carrying motor 210, a fuser/ejection motor 211, a DUP1 motor 212, a DUP2 motor 213, an intermediate transfer belt drive motor (ITBD) 214, a photosensitive drum drive motor 215, a sheet supply clutch 216, a registration clutch 217, a duplex registration (DUP Reg.) clutch 218, a DUP separator operation solenoid 219, a through separator operation solenoid 220, a high voltage supply unit 221, a charge bias generation part 222, a supply/development bias generation part 223, a primary transfer bias generation part 224 and a secondary transfer bias generation part 225 to drive and control each of configuration elements illustrated in FIG. 2. In FIG. 3, regardless of colors (types) of toner of the color image forming apparatus, configuration elements of the same types are illustrated as five layered blocks.

The host interface part 201 functions as an interface that communications with a supply source (host) of the image data, and processes transmission/receiving of data of the command/image process part 202.

The command/image process part 202 performs a process to output image data to the LED head interface part 203.

The LED head interface part 203 drives the LED head 103 of each of the development units 102 (causes the LED head 103 to emit light) according to an image signal supplied by the command/image process part 202.

The printer engine control part 204 controls the configuration elements of each of driven parts according to the command/image process part 202. The printer engine control part 204 includes a motor control part 205, a high voltage control part 206, a fuser control part 207 and clock generation part 226. The printer engine control part 204 functions to control LED head drive pulses of the LED head interface part 203 and the like and to process signals of the respective sheet carriage sensors. Moreover, the printer engine control part 204 controls the sheet supply clutch 216, the registration clutch 217, the DUP registration clutch 218, the DUP separator operation solenoid 219 and the through separator operation solenoid 220.

The clock generation part 226 generates clock signals to synchronize timing of respective controls in the printer engine control part 204.

The motor control part 205 controls the sheet supply motor 209, the carrying motor 210, the fuser/ejection motor 211, the DUP1 motor 212, the DUP2 motor 213, the intermediate transfer belt drive motor 214 and the photosensitive drum drive motor 215. The motor control part 205 performs operation controls at the timing based on the clock signals to synchronize operations of the respective motors.

The sheet supply motor 209 is a motor to drive the pickup roller 121, the pair of sheet supply rollers 122 and the pair of registration rollers 125. The carrying motor 210 is a motor to drive the pair of carrying rollers 127, 128 and 132 as well as the pair of DUP registration rollers 147. The fuser/ejection motor 211 is a motor to drive a roller in the fuser unit 131 (discussed below in detail) and pairs of carrying rollers 148 and 150. The DUP1 motor 212 is a motor to drive the inversion rollers 136 and the pair of carrying rollers 142. The DUP2 motor 213 is a motor to drive the pairs of carrying rollers 140, 143 and 145. The intermediate transfer belt drive motor 214 is a motor to drive the drive roller 113 arranged in the intermediate transfer belt 112. The photosensitive drum drive motor 215 is a motor to drive and rotate the photosensitive drum 109 of each development unit 102.

The sheet supply clutch 216 is a clutch that connects the pickup roller 121 and the pair of sheet supply rollers 122 to the sheet supply motor 209. The registration clutch 217 is a clutch that controls an operation of the pair of registration rollers 125. The DUP registration clutch 218 is a clutch that controls an operation of the pair of DUP registration rollers 147. The DUP separator operation solenoid 219 opens and closes the DUP separator 133. The through separator operation solenoid 220 opens and closes the through separator 137.

The high voltage control part 206 notifies the high voltage supply unit 221 of target value signals of a charging bias, a supply bias, a development bias, the primary transfer bias and the secondary transfer bias as well as bias application timing. The high voltage control part 206 includes the charge bias generation part 222, the supply/development bias generation part 223, the primary transfer bias generation part 224 and the secondary transfer bias generation part 225. The charge bias generation part 222 generates a bias voltage applied to the charge roller 105 of each development unit 102. The supply/development bias generation part 223 applies a bias voltage to the supply roller 106 and the development roller 107 of each development unit 102. The primary transfer bias generation part 224 applies a bias voltage to each primary transfer roller 111(each primary transfer roller 111 that faces each development unit 102). The secondary transfer bias generation part 225 applies a bias voltage to the secondary transfer roller 117. The fuser control part 207 controls the fuser unit 131.

Next, an internal configuration of the fuser unit 131 as a fuser part is explained with reference to FIG. 4.

Figure 4:
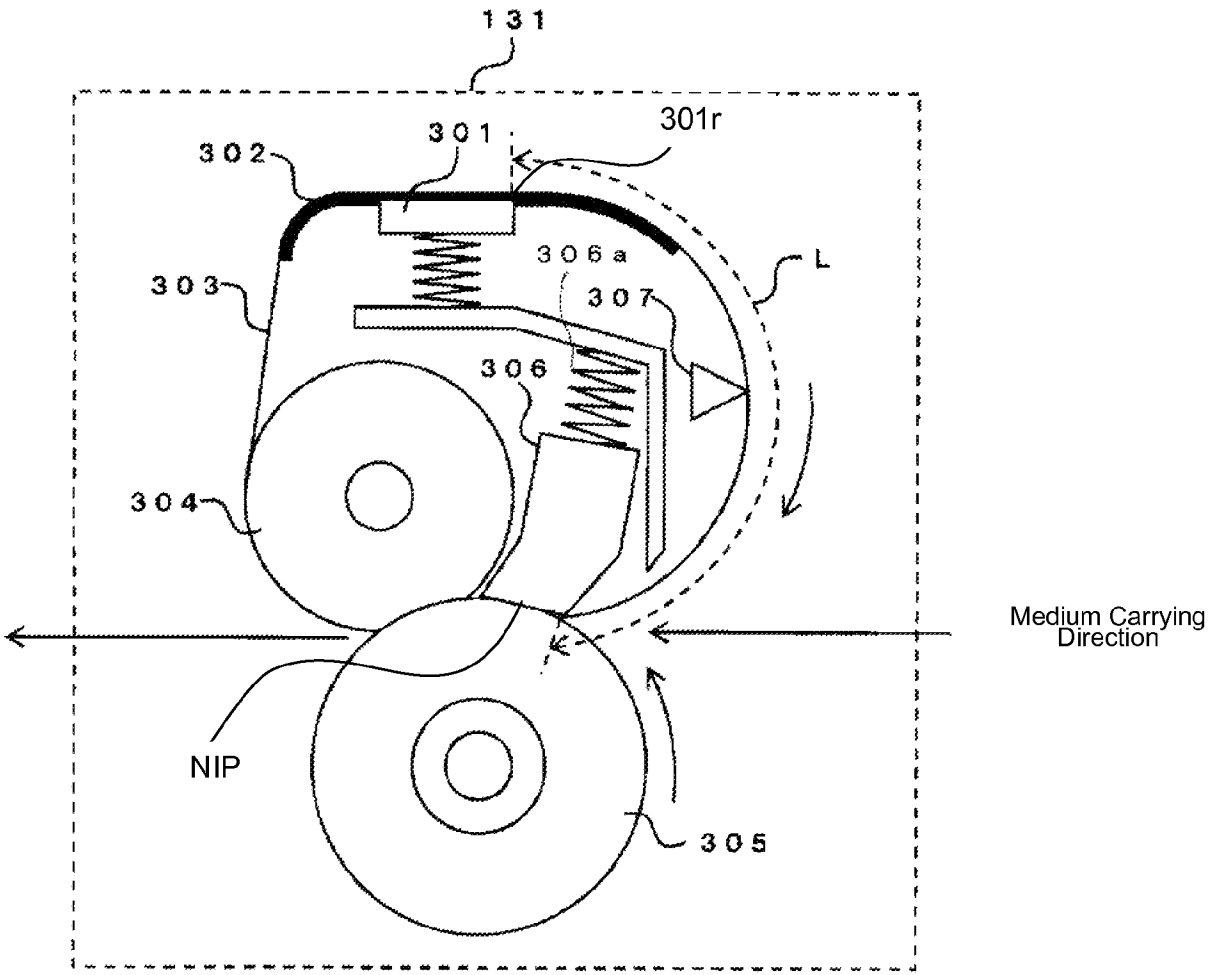
FIG. 4 is a schematic cross-sectional diagram of a fuser unit according to the first embodiment.

FIG. 4 is a schematic cross-sectional diagram of the fuser unit 131.

As illustrated in FIG. 4, the fuser unit 131 includes a heater 301 as a heat application member, a thermal diffusion 302, a fuser belt 303, a drive roller 304, a fusion backup roller 305, a pressing pad 306 and a thermistor 307.

The fuser belt 303 as a fuser member is an endless belt.

The thermal diffusion 302 stretches the fuser belt 303, and spreads (diffuses) heat of the heater 301 to the fuser belt 303 when the thermal diffusion 302 frictions the fuser belt 303. Namely, the heater 301 is arranged on the inside of the fuser belt 303 to be in contact with the thermal diffusion 302.

The drive roller 304 as a fuser member drive part drives and rotates the fuser belt 303, and is arranged on the inside of the fuser belt 303. The drive roller 304 is a roller driven by the above-discussed fuser/ejection motor 211.

The pressing pad 306 as a nip formation member is arranged on the inside of the fuser belt 303, and functions as a pad(pressing member) to ensure a part that sandwiches the sheet P (hereinafter, referred to as a "fusion NIP"). The fusion NIP, more specifically its leading edge, is shown as NIP in FIG. 4.

The fusion backup roller 305 as a facing member is a roller arranged at a position in which the fusion backup roller 305 faces the drive roller 304 and the pressing pad 306 on the outside of the fuser belt 303. The pressing pad 306 is biased by a spring 306*a* in a direction in which the pressing pad 306 presses the fusion backup roller 305. Namely, parts in which the fusion backup roller 305 abuts on the drive roller 304 and the pressing pad 306 form the above-discussed fusion NIP (or nipping part).

Heat and pressure are applied to the sheet P carried to the fuser unit 131 to perform the fusion process of the toner at the fusion NIP (abutment part) in which the fusion backup roller 305 abuts on the drive roller 304 and the pressing pad 306.

The thermistor 307 is a temperature detection part to control ON/Off states of the heater 301 and the like. In the first embodiment, the thermistor 307 detects a surface temperature of the fuser belt 303.

Next, a functional configuration of the fuser control part 207 is explained with reference to FIG. 1.

Figure 1:
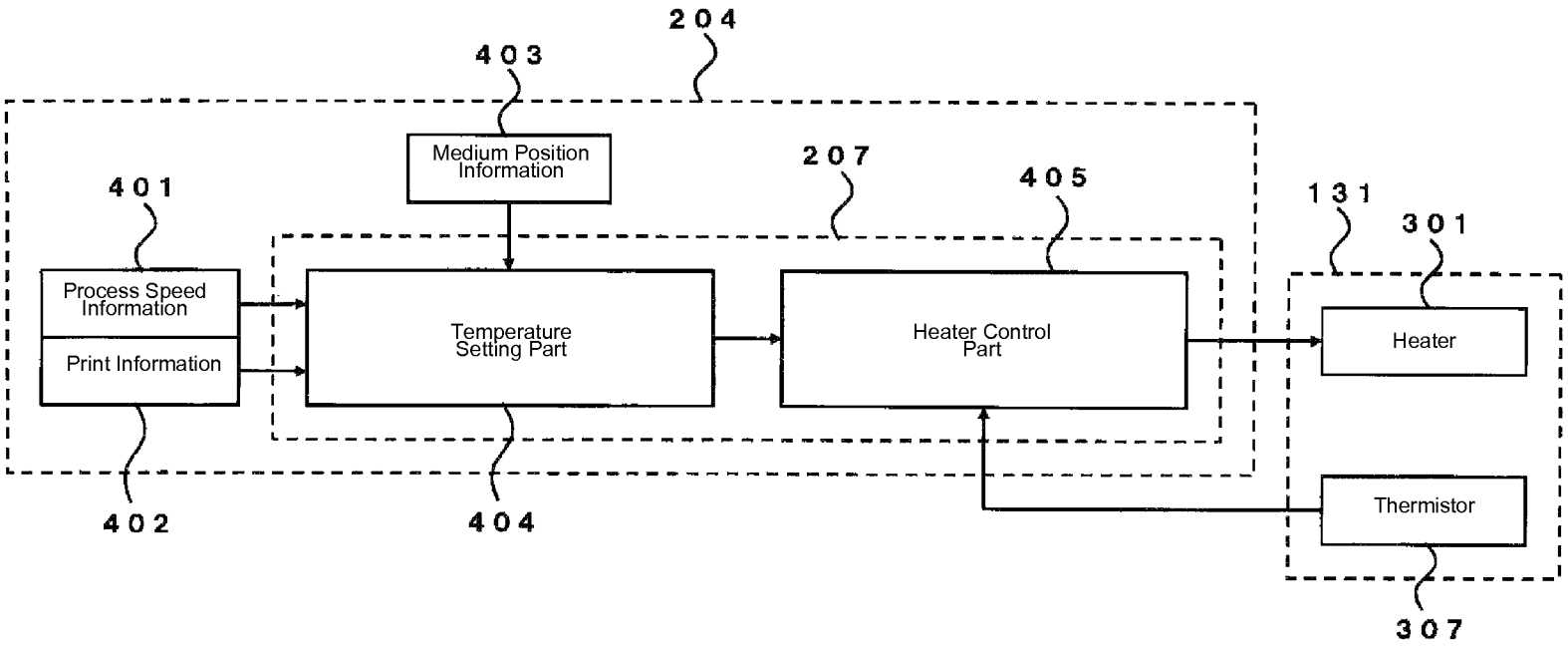
FIG. 1 is a block diagram of a functional configuration of a fuser control part that configures an image forming apparatus according to a first embodiment.

FIG. 1 is a block diagram of the functional configuration of the fuser control part 207. In FIG. 1, the same or corresponding reference numbers are put to parts that are same as or correspond to those in FIGS. 2 to 4 discussed above.

The fuser control part 207 includes a temperature setting part 404 as a temperature setting means and a heater control part 405 as a heat application control part. The temperature setting part 404 sets a target range of the surface temperature of the fuser belt 303. The heater control part 405 controls the ON/Off states of the heater 301 and the like.

The fuser device of the first embodiment is built by using the fuser unit 131 and fuser control part 207. The fuser control part 207 may be realized only by hardware (dedicated chip or circuit and the like). The fuser control part 207 may also be realized by installing a fuser control program on an implementation configuration of a program configured by a processor, a memory and the like.

Process speed information 401, print information 402 and medium position information 403 are input in the temperature setting part 404. The medium position information 403 is obtained by counting operation clock signals and the like generated by the clock generation part 226 based on timing at which the secondary transfer sensor 129 detects a leading edge of the sheet P.

Target temperature range information set by the temperature setting part 404 and a detection temperature detected by thermistor 307 are input in the heater control part 405.

(A-2) Operation in First Embodiment

Next, an operation of the image forming apparatus 101 of the first embodiment that includes the above-described configuration is explained.

First, an operation of the entire image forming apparatus 101 is explained with reference to FIGS. 2 to 4.

Print data is input from a host (e.g. an external device such as PC and the like, not illustrated) to the command/image process part 202 of the image forming apparatus 101 via the host interface part 201. The print data is described in Page Description Language (PDL) and the like. The input print data is converted into bitmap data by the command/image process part 202.

The printer engine control part 204 is activated by the command/image process part 202. The heater 301 of the fuser unit 131 is controlled by the printer engine control part 204 (fuser control part 207) according to a detection value detected by the thermistor 307. After the detection value detected by the thermistor 307 reaches a predetermined temperature, a print operation starts.

The sheet P set in the sheet supply cassette 120 is fed by the pickup roller 121 ant the pair of sheet supply rollers 122 driven by the sheet supply motor 209 by the control by the printer engine control part 204. The rollers 121 and 122 are connected to the sheet supply motor 209 by the sheet supply clutch 216, and rotation and stoppage of the rollers are controlled according to ON/Off states of the sheet supply clutch 216.

Next, the sheet P is carried along the sheet carrying path 123 by the control by the printer engine control part 204. The sheet P contacts the pair of registration rollers 125 in a stoppage state (the registration clutch 217 is in an OFF state), and the skew of the sheet P is corrected. Adjustment of the contact amount is performed according to a time period from that the registration sensor 124 detects the leading edge of the sheet P to that the registration clutch 217 shifts into an ON state. The contact amount is defined an extra length for which the skewed sheet is further carried after a leading edge of the skewed sheet reaches to one of the registration rollers 125 until the sheet is arranged along the medium carrying direction. Due to the extra length of the carry, the skewed sheet can rotate around the first contact portion with the roller 125, thereby the skew is corrected. In a practical use, the contact amount is within 1 to 5 mm.

Next, the printer engine control part 204 temporarily stops the carrying motor 210 as the sheet P travels a predetermined distance after the carriage sensor 126 detects the leading edge of the sheet P. In the meantime, at this time, the LED head 103 of each development unit 102 is lighted by the LED head interface part 203 according to the bitmap data. Thereby, a toner image is formed on the photosensitive drum 109 in each development unit 102 according to an electrographic process.

The toner image developed by each development unit 102 is primarily transferred onto the intermediate transfer belt 112 by the primary transfer bias which is applied to each primary transfer roller 111. The temporarily stopped carrying motor 210 resumes at the timing at which the toner image on the intermediate transfer belt 112 coincides with the leading edge position of the sheet P on the secondary transfer roller 117 based on start of exposure in the development unit 102T positioned at the top of the upstream. Here, the timing at which the secondary transfer bias is applied is based on the time when the secondary transfer sensor 129 detects the leading edge of the sheet P. The timing is the timing at which the leading edge of the sheet P contacts the secondary transfer roller 117. The secondary transfer bias is controlled by printer engine control part 204. Meanwhile, the timing at which the secondary transfer bias controlled by printer engine control part 204 is stopped to be applied is based on the time when the secondary transfer sensor 129 detects the trailing edge of the sheet P. The timing is the timing at which the trailing edge of the sheet P has passed the secondary transfer roller 117.

After, the toner image has been fixed by the fuser unit 131, the sheet P is carried along the sheet carrying path 149 and is ejected on the face down stacker 151. The drive roller 304 of the fuser unit, the pairs of carrying rollers 132, 148 and 150 are driven by the fuser/ejection motor 211. The toner cartridge 104 is removably installed to the development unit 102, and is configured to supply the development unit 102 with the toner therein.

Here, an operation when images are formed on both surface of the sheet P (Duplex printing) is explained.

After the fusion on a first surface of the sheet P has been performed at the fuser unit 131, the printer engine control part 204 causes the DUP separator 133 to shift into an open state, and guides the sheet P to the sheet carrying path 134. The DUP separator 133 is operated by the DUP separator operation solenoid 219.

The timing at which the printer engine control part 204 opens the DUP separator 133 is based on the time when the secondary transfer sensor 129 detects the leading edge of the sheet P. The timing is the timing at which the leading edge of the sheet P arrives at the front edge of the DUP separator 133. At this time, the through separator 137 is in the open state (the through separator operation solenoid 220 is in an ON state), and guides the leading edge of the sheet P to the temporary retreat place 138.

The printer engine control part 204 drives the inversion rollers 136 and the pair of carrying rollers 142 with the DUP1 motor 212. The printer engine control part 204 stops the DUP1 motor 212 and drives to invert the DUP1 motor 212 to carry the sheet P along the sheet carrying paths 141 and 144 as the inversion sensor 135 detects the trailing edge of the sheet P. The pairs of carrying rollers 143 and 145 are driven by the DUP2 motor 213.

The pair of DUP registration rollers 147 is driven by the carrying motor 210, and is rotated and stopped when the DUP clutch 218 shifts into ON/OFF states.

Next, the printer engine control part 204 cause the sheet P to contact the pair of DUP registration rollers 147 in a stoppage state (the DUP clutch 218 is in an OFF state), and the skew of the sheet P is corrected. Adjustment of the contact amount performed by the printer engine control part 204 is performed according to a time period from that the DUP registration sensor 146 detects the leading edge of the sheet P to that the DUP clutch 218 shifts into an ON state.

The printer engine control part 204 temporarily stops the carrying motor 210 and cause the sheet P to temporarily wait as the sheet P travels a predetermined distance from the pair of DUP registration rollers 147. The printer engine control part 204 causes the temporarily stopped carrying motor 210 to resume at the timing at which the toner image on the intermediate transfer belt 112 coincides with the leading edge position of the sheet P on the secondary transfer roller 117 based on start of exposure in the development unit 102T positioned at the top of the upstream (hereinafter, the operation is referred to as 'Resupply").

Hereinafter, the image forming apparatus 101 secondarily transfers and fixes the toner image on a second surface (other surface) of the sheet P, and ejects the sheet P in the same manner as the first surface of the sheet P.

The first surface of the first sheet P, the first surface of the second sheet P, the second surface of the first sheet P, the first surface of the third sheet P, the second surface of the second sheet P, the first surface of the fourth sheet P, . . . , sequentially reach the secondary transfer roller 117 and the fuser unit 131.

Next, in the image forming apparatus 101, an operation during performing the transfer and fusion of a toner image on the same surface of the sheet P in twice (two fusion printing) is explained.

After the first fusion on the first surface of the sheet P has been performed at the fuser unit 131, the printer engine control part 204 controls the DUP separator 133 so that the DUP separator 133 shifts into the open state, and guides the sheet P to the sheet carrying path 134 when the image forming apparatus 101 performs a Duplex operation in the same manner as the above-discussed Duplex operation (Duplex printing). In the case of the two fusion printing, unlike the time when the duplex printing is performed, the printer engine control part 204 does not stop or invert the inversion rollers 136. The printer engine control part 204 keeps the through separator 137 in a closed state (the through separator operation solenoid 220 is in an OFF state), and guides the sheet P to the sheet carrying path 139. Hereinafter, after the skew of the sheet P is corrected by the DUP registration roller 147, the image forming apparatus 101 performs the second secondary transfer and fusion, and ejects the sheet P in the same manner as the Duplex printing.

In the image forming apparatus 101, sheets P. which sequentially reach the secondary transfer roller 117 and the fuser unit 131, are processed in the following order in the same manner as the Duplex printing:

the first process of the first sheet->the first process of the second sheet->the second process of the first sheet->the first process of the third sheet->the second process of the second sheet->the first process of the fourth sheet.

Next, operations of the fuser control part 207 and the fuser unit 131 are explained in detail.

The temperature setting part 404 in the fuser control part 207 sets the target temperature range of the surface temperature of the fuser belt 303 according to the Process speed information 401, print information 402, medium position information 403.

The print information 402 is information on conditions to perform a next fusion process. Specifically, the print information 402 may include information such as a type and thickness of a sheet P on which the next fusion process is performed, colors (types) of toner fixed on the sheet P, the numbers of toner layers, whether the sheet P is a sheet supplied from the sheet supply cassette 120 or is a resupplied sheet supplied from the sheet carrying path 144. When patterns of types of the sheet P on which the fusion process is performed and the colors of the toner to be used are determined, an identification number may be put to each of the patterns and used as the print information 402 in the image forming apparatus 101.

The medium position information 403 is information based on timing at which the secondary transfer sensor 129 detects the leading edge of the sheet P.

In the first embodiment, the following example is explained: an upper limit of the target temperature is 180° C., and a lower limit of the target temperature is 150° C. in the example. The heater control part 405 controls the ON/Off states of the heater 301 so that the detection value detected by the thermistor 307 ranges within the target temperature range.

A control method performed by the heater control part 405 is not limited. The following control (Hereinafter, referred to as "first control method") may be performed: threshold values to switch ON/OFF states of the heater are set; the heater is switched ON when a temperature lower than a "heater ON threshold value" is detected; the heater is switched OFF when a temperature higher than a "heater OFF threshold value" is detected, for example. The heater ON threshold value is a threshold value to cause the heater control part 405 to switch ON the heater 301 when the detection temperature detected by the thermistor 307 is equal to the heater ON threshold value or lower while the detection temperature reduces from a high temperature (a temperature higher than the heater ON threshold value) to a low temperature (at this time, the heater 301 is in the OFF state). The heater OFF threshold values a threshold value to cause the heater control part 405 to switch OFF the heater 301 when the detection temperature detected by the thermistor 307 is equal to the heater OFF threshold value or higher while the detection temperature increases from a low temperature (a temperature lower than the heater OFF threshold value) to a high temperature (at this time, the heater 301 is in the ON state).

In addition, another control method may be performed by the heater control part 405 as follows: power applied to the heater may be gradually controlled (Hereinafter, referred to as "second control method"). In addition, another control method may be performed by the heater control part 405 as follows: a temperature variation gradient of the detection temperature detected by the thermistor 307 is detected; a temporary storage part and the like are provided to perform a proportional integral derivative control (i.e., PID control, hereinafter, referred to as "third control method").

Figure 5:
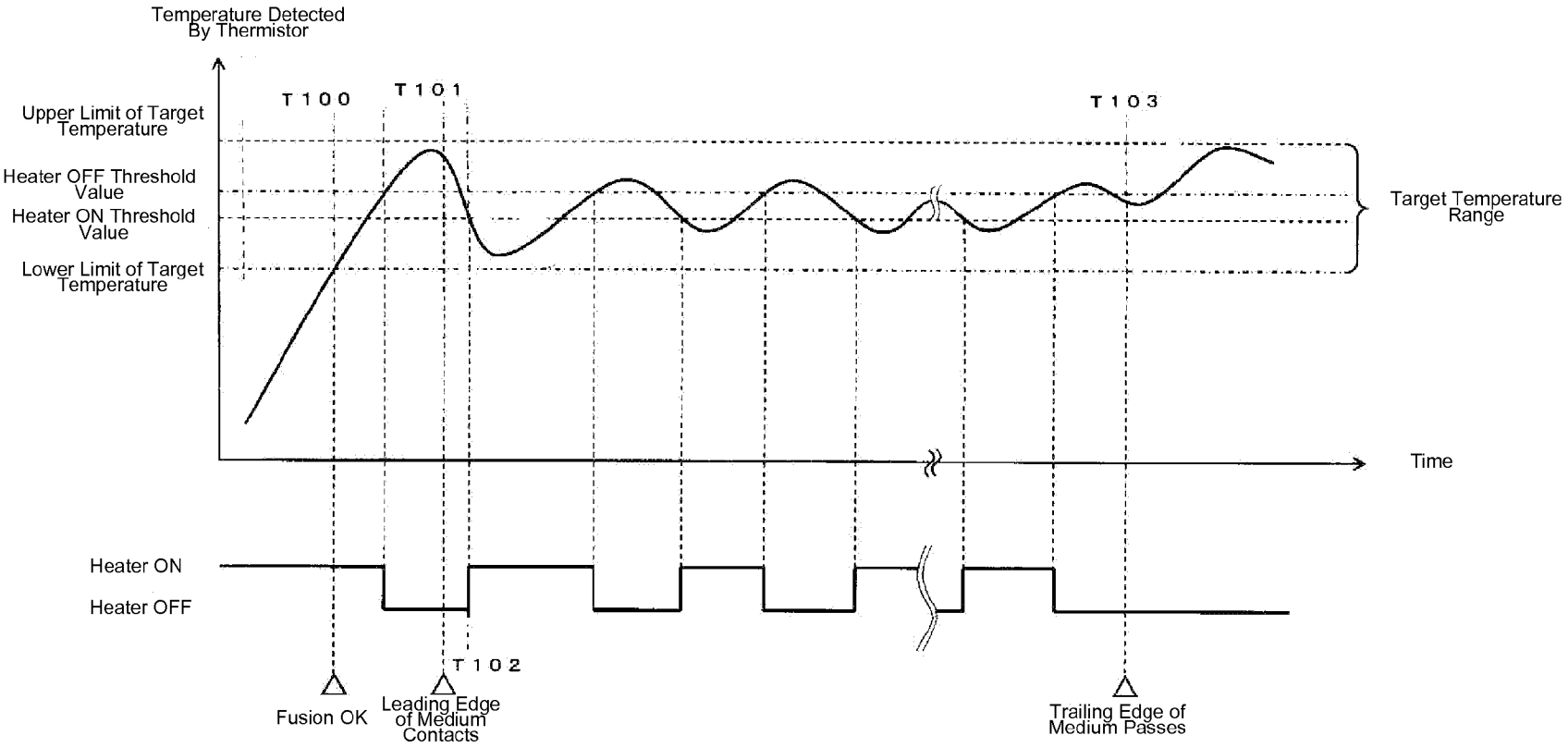
FIG. 5 is a timing chart of an operation example of a heater control part of the fuser control part according to the first embodiment that controls a heater.

Next, an operation when the fuser control part 207 controls the fuser unit 131 according the above-discussed first control method is explained with reference to FIG. 5. The horizontal axis indicates the time; the vertical axis indicates the temperature detected by the thermistor 307 in FIG. 5.

After the fuser control part 207 has received the above-discussed printing request, the fuser control part 207 switches ON the heater 301 to start the heat application to the fuser unit 131. The fuser control part 207 judges "Fusion OK" (i.e., the fusion may be performed) as the detection value detected by the thermistor 307 enters into a lower limit of the target temperature range. The fuser control part 207 starts the image formation and sheet carriage (see the timing T100 in FIG. 5). Hereinafter, the sheet P on which a toner image has been transferred is referred to as "medium" seen from the fuser unit 131. When the leading edge of the medium contacts the fuser unit 131, heat of the fuser belt 303 is absorbed into the medium and the temperature drop (the rapid drop of the detection temperature) occurs (see the timing T101 to T102 in FIG. 5). When the trailing edge of the medium passes the fuser unit 131, the temperature overshoot (a state in which the detection temperature exceeds an upper limit of the target temperature) occurs (see the timing T103 and thereafter in FIG. 5). Namely, in FIG. 5, the lower limit of the target temperature range is set as a result of the consideration of the temperature drop. The temperature overshoot is a phenomenon that occurs after the fusion is completed on the medium. When the printing continues, following mediums come. Therefore, the temperature overshoot needs to be controlled to be substantially equal to the upper limit of the target temperature range or lower.

Here, in the image forming apparatus 101, the case in which the above-discussed twice fusion printing is performed is discussed. In the image forming apparatus 101, when the fusion processes are performed twice like the twice fusion printing, there is a usage in which transparent toner is coated on a multi-color developer image after the multi-color developer image formed with four color (KCMY) toner has been fixed in the first fusion process in order to gloss a printed image, for example. In this case, four color toner (four layers) is fixed in the first fusion process, and single color toner (one layer) is fixed in the second fusion process. Therefore, print quality can be more favorable when the target temperature range in the first fusion process is higher than that in the second fusion process. On the other hand, when the surface of the sheet P on which the transparent toner has been fixed is not flat and preferable gloss is not obtained, the target temperature range in the second fusion process can be higher than that in the first fusion process to melt the toner layer efficiently. As discussed above, in the image forming apparatus 101, when the fusion printing performed twice continues, a medium on which the first fusion is performed and a medium on which the second fusion is performed alternately reaches the fuser unit 131. Therefore, the target temperature range of the fuser unit 131 repeatedly increases and reduces in response to the mediums. Herein, a toner image that is formed first on one side of sheet is a first developer image. Anther toner image that is formed on the first developer image is a second developer image.

Figure 6:
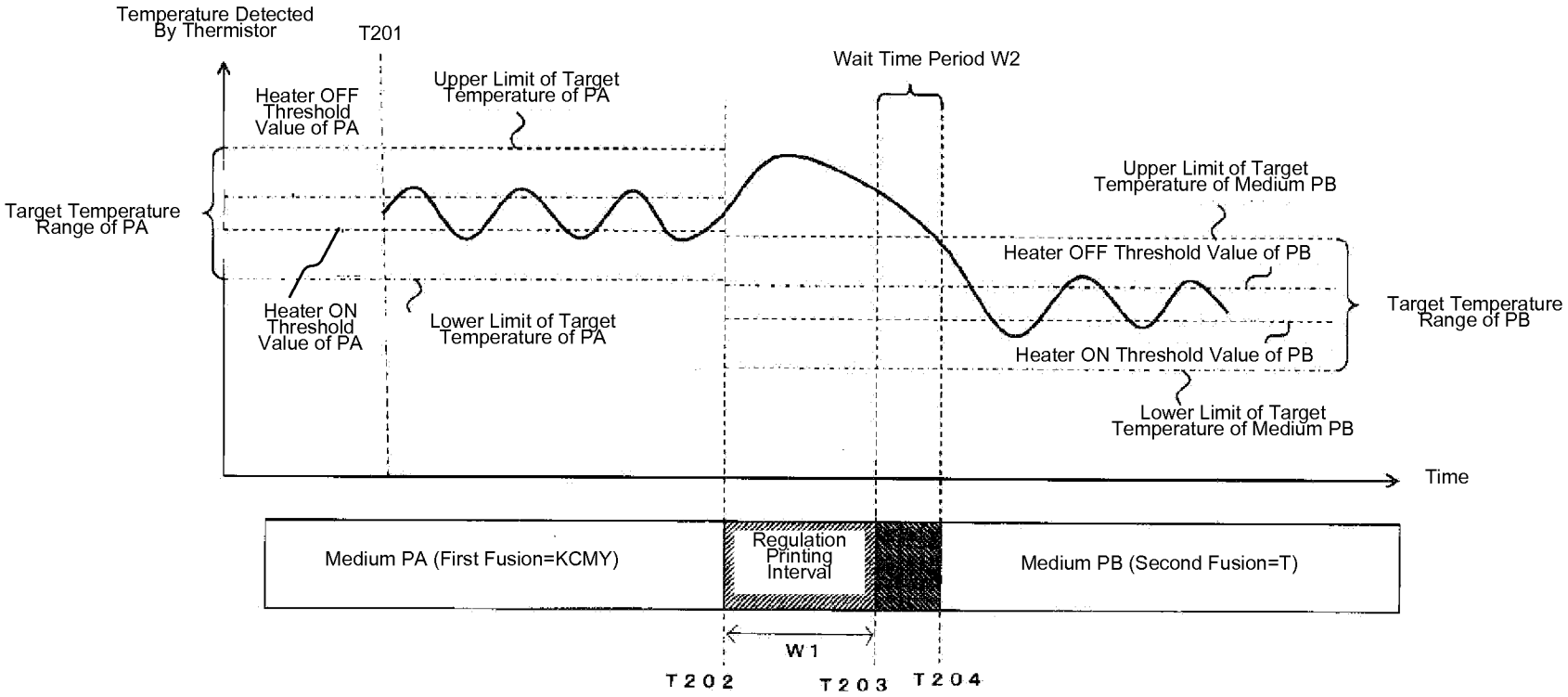
FIG. 6 is a timing chart of a problem when the fuser control part according to the first embodiment controls the heater control part.

Next, in the image forming apparatus 101, the following example is explained with reference to FIG. 6: transition of the detection temperature detected by the thermistor 307 (the surface temperature of the fuser belt 303) when a medium PB (a following second medium) of which a low target temperature range is supplied (resupplied) after a medium PA (a preceding first medium) of which a high target temperature range is supplied. In the example in FIG. 6, the detection temperature when the fuser control part 207 controls the fuser unit 131 according the above-discussed first control method is illustrated in the same manner as the above-discussed FIG. 5. In FIG. 6, the following example is explained: an upper limit of the target temperature of the medium PA is 180° C.; a lower limit of the target temperature of the medium PA is 150° C.; an upper limit of the target temperature of the medium PB is 175° C.; and a lower limit of the target temperature of the medium PB is 145° C. in the example. FIG. 6 illustrates the following comparative example: the control of fusion temperature is performed to tailor the detection value to the target temperature range of the medium PB after the fusion on the medium PA is completed.

In the state in which the fusion temperature is controlled to tailor the detection value to the target temperature range of the medium PA (at the timing T201) in the fuser unit 131, when the trailing edge of the medium PA passes the fuser unit 131, the temperature overshoot occurs (at the timing T202 and thereafter in FIG. 6) as discussed above. Next, the target temperature range that corresponds to the supplied medium PB is lower than the medium PA. Therefore, the image forming apparatus 101 suspends the image formation operation until a temperature of the fuser unit 131 (the detection temperature detected by the thermistor 307) falls within the target temperature range that corresponds to the supplied medium PB. As a result, a waste wait time period W2 occurs after a regulation printing interval W1 determined as an apparatus specification in advance.

Accordingly, the control to decrease the wait time period W2 as illustrated in FIG. 6 is performed in the image forming apparatus 101 (the fuser control part 207) of the first embodiment. Specifically, in the image forming apparatus 101 (fuser control part 207), while the first medium PA passes the fuser unit 131, the target temperature range to control the heater 301 is varied to that of the second medium PB supplied next to the medium PA.

Next, the control of the image forming apparatus 101 (the fuser control part 207) of the first embodiment is explained in detail with reference to FIG. 7.

Figure 7:
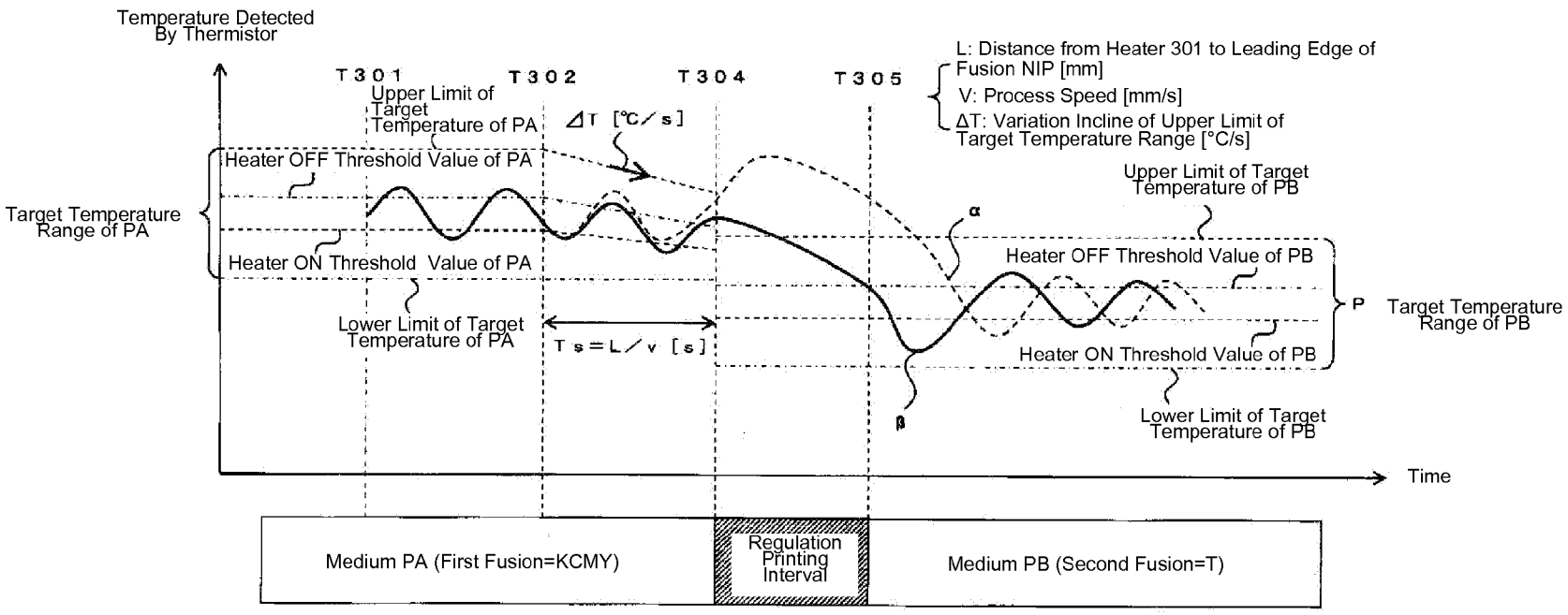
FIG. 7 is a timing chart of an operation example of the fuser control part according to the first embodiment that controls the heater control part.

FIG. 7 illustrates a broken line $\alpha$ of a temperature wave and solid line $\beta$. The broken line $\alpha$ indicates the temperature when the target temperature range is not varied while the medium PA passes the fuser unit 131 (i.e., the same temperature wave in FIG. 6). The solid line $\beta$ indicates the temperature when an upper limit of the target temperature range is varied while the medium PA passes the fuser unit 131.

In FIG. 7, the fuser control part 207 gradually reduces the upper limit of the target temperature range from the timing T302 a duration Ts prior to the timing T304 at which the medium PA has passed the fuser unit 131. Thereby, the fuser control part 207 reduces the surface temperature of the fuser belt 303 to a lower range in the target temperature range along the trailing edge of the medium PA. As a result, the detection temperature ranges within the next target temperature range of the medium PB during the regulation printing interval W1 in the fuser unit 131. Accordingly, the wait time period W2 in which the surface temperature of the fuser belt 303 reduces does not occur. The wait time period W2 is shorter than the example in FIG. 6 even if the wait time period W2 occurs.

In the first embodiment, as illustrated in FIG. 7, the above-discussed duration Ts is determined by the following equation:

$$Ts=L/v[s]$$

where "L (first distance)" is defined as a distance from the rear end 301*r* of heater 301 to the leading edge of the fusion NIP (see FIG. 4 discussed above); "v" denotes the process speed (the speed at which the medium passes the fuser unit 131). As illustrated in the above-discussed FIG. 4, the part is a part that has already passed the heater 301. An influence of the temperature reduction to a part of the surface of the fuser belt 303 that in contact with the medium is small even if the heater 301 is totally switched OFF at the timing. Therefore, the risk of the occurrence of a fusion defect such as cold offset and the like is small. In the invention, the leading edge of the fusion NIP is defined as a portion where the medium contacts the belt 303 first in the medium carrying direction. In other words, that is the most upstream portion of the area where the belt 303 and roller 305 sandwich the medium. In this embodiment, the leading edge of the fusion NIP is an edge where the pad 306 contacts the belt 303.

In the first embodiment, the following example is explained: when the upper limit of the target temperature range is varied, the heater ON/OFF threshold values are varied in the same manner as the variation of the upper limit of the target temperature range at the same time. In addition, the power applied to the heater 301 may be controlled, or a control gain thereof may be varied to tailor to the upper limit of the target temperature range when the PID control is performed.

As described above, in the first embodiment, the upper limit of the target temperature range and the like start to vary the duration Ts (L/v) prior to the time at which the fusion is performed on the trailing edge of the medium. An absolute value of a variation incline ΔT of the of the upper limit of the target temperature range (temperature variation incline) needs to be smaller than an absolute value of a temperature gradient when the medium passes the fusion NIP in the state in which the heater 301 is in the OFF state. The value significantly depends on the configuration of the fuser unit 131 mainly. Furthermore, the value is influenced by a material and a thickness of the sheet P and the like. In addition, table values may be stored in a storage part of the printer engine control part 204 and be incorporate in the print information 402, for example. In the first embodiment, ΔT is equal to or lower than 0.5° C./s, for example. This prevents a trouble such as an apparatus error and the like in the following case: the surface temperature of the fuser belt 303 is the upper limit of the target temperature range immediately before the upper limit of the target temperature range is varied; the surface temperature of the fuser belt 303 departs from the target temperature range before the surface temperature falls even after the heater 301 is switched OFF (in fact, the temperature does not become a problem since the fusion is still performed on the medium PA). The fuser unit may be cooled by a cooling part (not illustrated) to increase ΔT so that the surface temperature comes to closer to the target temperature earlier. However, a duration in which the fusion process is not performed on the medium is not limited thereto.

Figure 8:
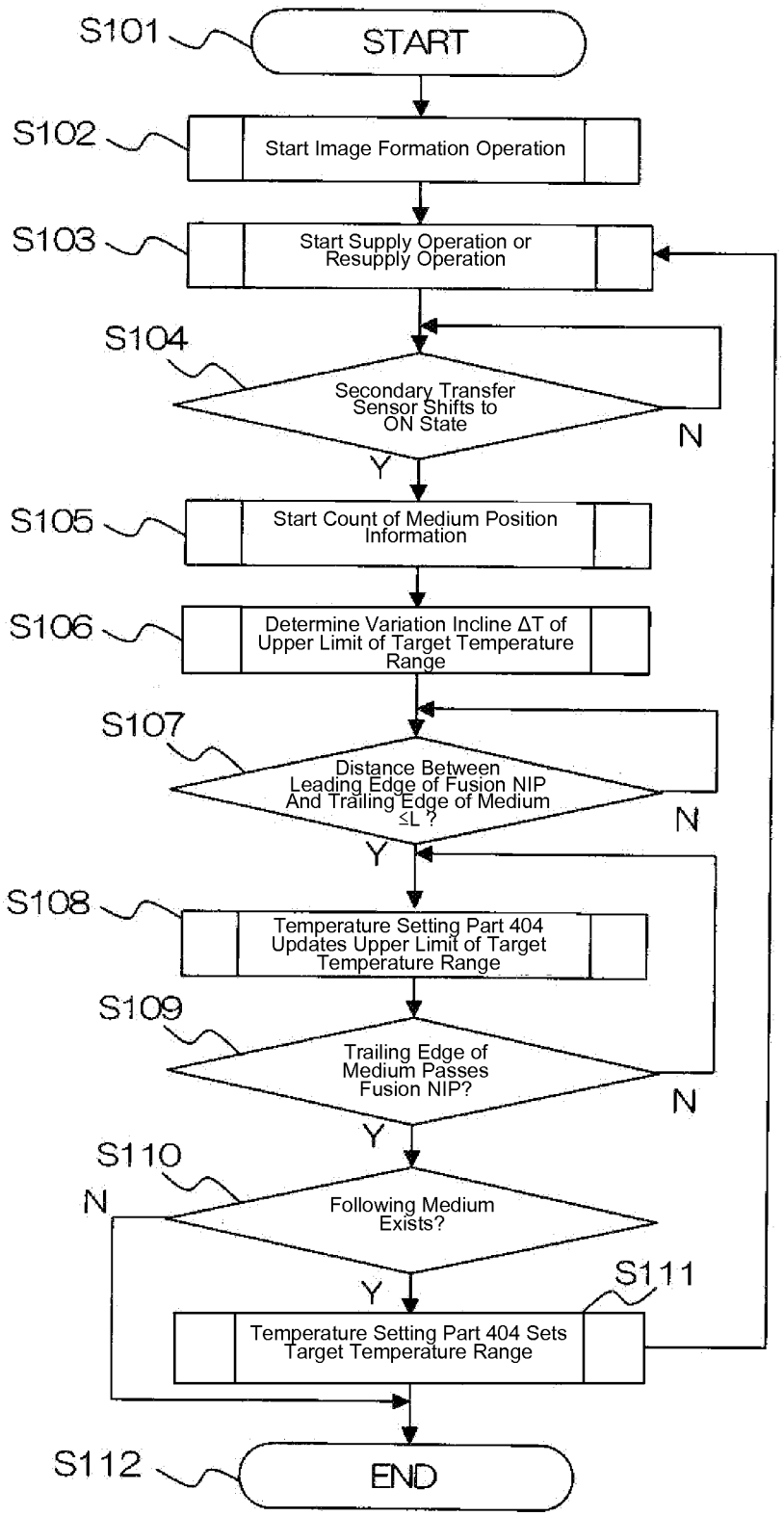
FIG. 8 is a flow diagram of an operation of the image forming apparatus according to the first embodiment.

Next, a process is explained with reference to a flow chart in FIG. 8: the process is performed when the upper limit of the target temperature range and the like starts to vary the duration Ts (L/v) prior to the time at which the fusion is performed on the trailing edge of the medium in the image forming apparatus 101, as FIG. 7 discussed above. In FIG. 8, the operation of the two fusion printing is performed in the image forming apparatus 101.

The print data described in Page Description Language (PDL) and the like is input from the host (e.g. an external device such as PC and the like, not illustrated) to the command/image process part 202 of the image forming apparatus 101 via the host interface part 201, and the image formation operation starts (S101 and S102).

In the image forming apparatus 101, the following operation is performed: the sheet P on which no image has been transferred or the medium on which the first transfer and fusion process of a toner image are performed is supplied toward the sheet carrying path 130 on which the secondary transfer roller 117 is arranged (S103).

The medium is carried to the sheet carrying path 130 on which the secondary transfer roller 117 is arranged. When the secondary transfer sensor 129 shifts to the ON state (when the leading edge of the medium is detected, S104), the printer engine control part 204 start to count the medium position information (S105).

The fuser control part 207 determines the variation incline ΔT of the upper limit of the target temperature range that corresponds to the print information 402 (S106).

The fuser control part 207 controls the fuser unit 131 in a predetermined temperature range based on the process speed information 401 and the print information 402 until a distance between the leading edge of the fusion NIP and the trailing edge of the medium becomes equal to or shorter than L (S107).

Next, the fuser control part 207 (temperature setting part 404) updates the upper limit of the target temperature range and the like based on ΔT until the trailing edge of the medium passes the fusion NIP (S108 and S109).

The printer engine control part 204 observes whether or not a following medium exists (S110).

When the following medium exists, the fuser control part 207 (the temperature setting part 404) sets the target temperature range that corresponds to the next medium in the printer engine control part 204 (S111). The printer engine control part 204 operates from S103 discussed above.

In the meantime, when no following medium exists (S110 discussed above), the printer engine control part 204 ends the operation (S112).

(A-3) Effects of First Embodiment

According to the first embodiment, the following effect is achieved.

In the image forming apparatus 101, when the fusion process is continued to be performed on mediums of which the target temperature ranges are different from each other, the target temperature range is varied while the preceding medium passes the fuser unit 131 (during the fusion process). Thereby, the wait time period in which the surface temperature of the fuser belt 303 in the fuser unit 131 ranges within the target temperature range that corresponds to the following medium is shorten. Namely, an efficient fusion process is performed, and a fast throughput is realized in the image forming apparatus 101.

(B) Second Embodiment

A second embodiment of an image forming apparatus and a fuser device according to the present invention are explained in detail below with reference to the accompanying drawings.

(B-1) Configuration of Second Embodiment

An image forming apparatus 101A of the second embodiment is different from the image forming apparatus of the first embodiment as follow: the printer engine control part 204 is replaced with a printer engine control part 204A. In addition, a printer engine control part 204A of the second embodiment is different from the printer engine control part of the first embodiment as follows: the fuser control part 207 is replaced with a fuser control part 207A. A configuration of the second embodiment other than the printer engine control part 204A and the fuser control part 207A is the same as the first embodiment. Therefore, explanation on the configuration that is same as the first embodiment is omitted.

The differences between the second embodiment and the first embodiment are explained below.

Figure 9:
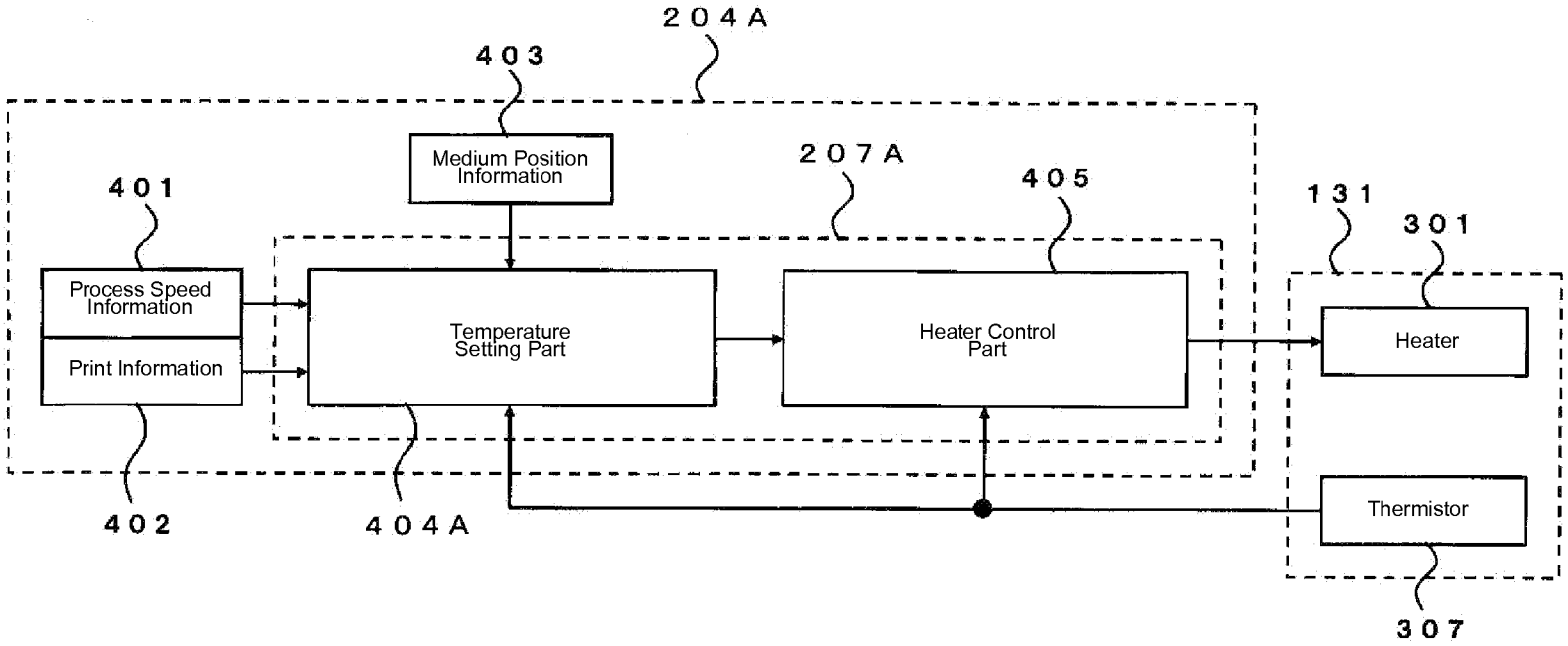
FIG. 9 is a block diagram of a functional configuration of a fuser control part that configures an image forming apparatus according to a second embodiment.

FIG. 9 is a block diagram of the functional configuration of the fuser control part 207A of the second embodiment.

A fuser control part 207A of the second embodiment is different from the fuser control part of the first embodiment as follows: the temperature setting part 404 is replaced with a temperature setting part 404A. The temperature setting part 404A is different from the temperature setting part of the first embodiment as follows: the temperature setting part 404A considers the detection temperature detected by the thermistor 307 and controls the target temperature range.

(B-2) Operation in Second Embodiment

Next, an operation of the image forming apparatus 101A of the second embodiment that includes the above-described configuration is explained. Parts of the operation of the image forming apparatus 101A of the second embodiment that are different from the first embodiment are explained below.

The fuser control part 207A (temperature setting part 404A) of the second embodiment considers the detection temperature detected by the thermistor 307 and controls Ts while the medium PA passes the fuser unit 131.

Figure 10:
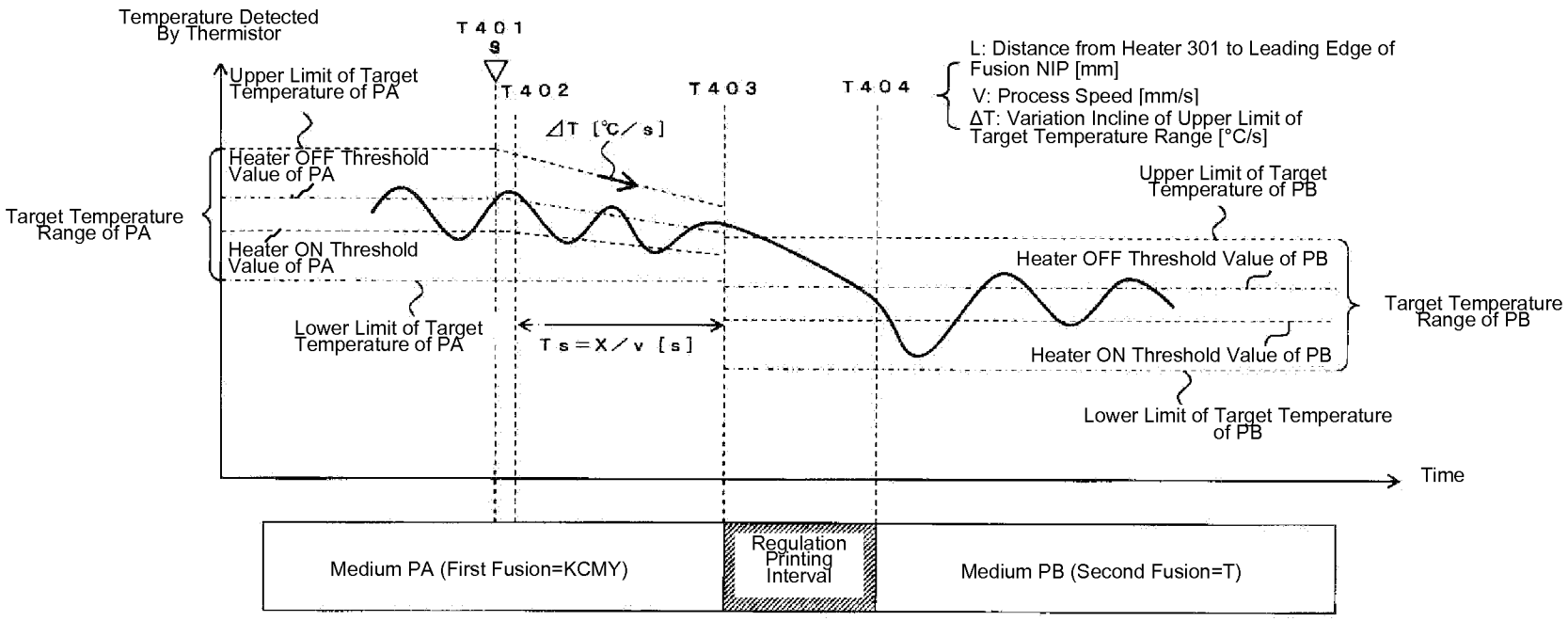
FIG. 10 is a timing chart of an operation example of the fuser control part according to the second embodiment that controls a heater control part.

FIG. 10 is a timing chart of an operation of the fuser control part 207A (temperature setting part 404A) to set an upper limit of the target temperature range.

The fuser control part 207A (temperature setting part 404A) obtains the detection temperature detected by the thermistor 307, and determines Ts at the timing (timing T401 in FIG. 10) that is a predetermined position while the medium passes the fuser unit 131. Specifically, in the second embodiment, the fuser control part 207A (temperature setting part 404A) obtains the detection temperature detected by the thermistor 307, and determines Ts at the timing at which the distance from the leading edge of the medium to the leading edge of the fusion NIP is S (second distance) (>L).

In second embodiment, the following example is explained: the above-discussed timing T401 is the timing at which the medium travels ½ of a length of the medium after the medium contacts the fuser unit 131. Namely, in the second embodiment, the above-discussed distance is set to S. S is ½ of the length of the medium.

When the detection temperature obtained by the fuser control part 207A (temperature setting part 404A) at the timing T401 is higher than a predetermined temperature, the variation of the target temperature starts at X (S>X>L) from the trailing edge of the medium. In the second embodiment, for example, the above-discussed "predetermined temperature" is determined by (upper limit of the target temperature range+ lower limit of the target temperature range)×(2/3). X is, for example, determined by X=L+15 mm. X is not a fixed value. X may be changed according to a type and thickness of a sheet P, and the like. A length of X may be calculated from the value of ΔT (e.g. a lower limit value of the width of the target temperature range is determined. The length is obtained by calculating backward from the trailing edge of the medium to the extent that the length is not below the lower limit value).

Figure 11:
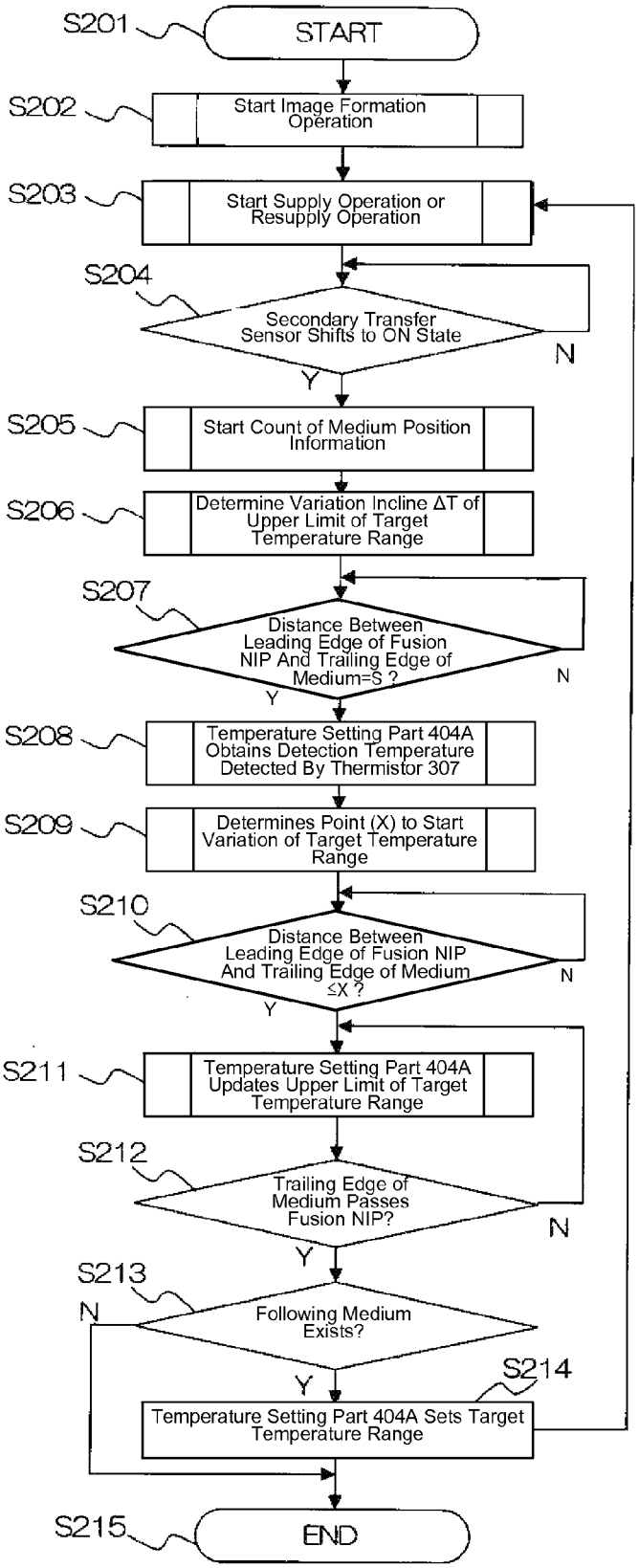
FIG. 11 is a flow diagram of an operation of the image forming apparatus according to the second embodiment.

Next, a process is explained with reference to a flow chart in FIG. 11: the process is performed when the upper limit of the target temperature range and the like starts to vary the duration Ts (X/v) prior to the time at which the fusion is performed on the trailing edge of the medium in the image forming apparatus 101A, as FIG. 10 discussed above. In FIG. 11, the operation of the two fusion printing is performed in the image forming apparatus 101A.

The print data described in Page Description Language (PDL) and the like is input from the host (e.g. an external device such as PC and the like, not illustrated) to the command/image process part 202 of the image forming apparatus 101A via the host interface part 201, and the image formation operation starts (S201 and S202).

In the image forming apparatus 101A, the following operation is performed: the sheet P on which no image has been transferred or the medium on which the first transfer and fusion process of a toner image are performed is supplied toward the sheet carrying path 130 on which the secondary transfer roller 117 is arranged (S203).

The medium is carried to the sheet carrying path 130 on which the secondary transfer roller 117 is arranged. When the secondary transfer sensor 129 shifts to the ON state (when the leading edge of the medium is detected, S204), the printer engine control part 204A start to count the medium position information (S205).

The fuser control part 207A determines the variation incline ΔT of the upper limit of the target temperature range that corresponds to the print information 402 (S206).

The fuser control part 207A controls the fuser unit 131 in a predetermined temperature range based on the process speed information 401 and the print information 402 until a distance between the leading edge of the fusion NIP and the trailing edge of the medium becomes S (S207).

Next, the fuser control part 207A (temperature setting part 404A) obtains the detection temperature detected by the thermistor 307 (S208), and determines a point (X) to start the variation of the target temperature range (S209).

The fuser control part 207A (temperature setting part 404A) waits until a distance between the leading edge of the fusion NIP and the trailing edge of the medium becomes equal to or shorter than X (S210).

Next, the fuser control part 207A (temperature setting part 404A) updates the upper limit of the target temperature range and the like based on ΔT until the trailing edge of the medium passes the fusion NIP (S211 and S212).

The printer engine control part 204A observes whether or not a following medium exists (S213).

When the following medium exists, the fuser control part 207A (the temperature setting part 404A) sets the target temperature range that corresponds to the next medium in the printer engine control part 204A (S214). The printer engine control part 204A operates from S203 discussed above.

In the meantime, when no following medium exists (S210 discussed above), the printer engine control part 204A ends the operation (S215).

(B-3) Effects of Second Embodiment

According to the second embodiment, the following effect is achieved.

In the image forming apparatus 101A, when the fusion is continued to be performed on mediums of which the target temperature ranges are different from each other, the variation of the target temperature range starts at the timing earlier than the first embodiment while the preceding medium passes the fuser unit 131. The variation starts when the surface temperature of the fuser belt 303 is equal to or higher than a predetermined temperature and within the target temperature range. Thereby, in the second embodiment, the wait time period W2 in which the surface temperature of the fuser belt 303 in the fuser unit 131 ranges within the target temperature range that corresponds to the following medium is shorten than the first embodiment. The surface temperature of the fuser belt 303 is preferably measured at its inner side of the belt 303. However, it might be practical to measure the surface temperature at its outer side.

(C) Other Embodiments

The present invention is not limited to the embodiments. Exemplified modifications are described below.

(C-1) In each embodiment, the image forming apparatuses according to the present invention are explained with a printer as an example. However, the usage of the image forming apparatuses according to the present invention is not limited thereto. The present invention may be implemented in a different type of image forming apparatus, for example, a printing apparatus, a photocopy apparatus, a multi function peripherals (MFP), a facsimile machine and the like.

A method to form an image in the image forming apparatus according to the present invention is not limited thereto. The transfer of the toner image generated using the LED heads onto the medium is performed in the image forming apparatus according to each embodiment, for example. However, a method to generate the toner image is not limited thereto. The supply of the medium to the image forming apparatus using the sheet supply cassette is performed in the image forming apparatus, for example. However, a method to supply the medium is not limited thereto.

(C-2) The following configuration and operation are performed in the image forming apparatus according to each embodiment: KMCY toner is fused in the first fusion printing; transparent toner is fused in the second fusion printing in the two fusion printing. However, the number of printing on one medium and the combination of toner are not limited thereto. White image (color of the ground) formation may be performed using white toner (single color toner) in the first fusion; four color KMCY toner image (chromatic image) formation may be performed in the second fusion; toner may be other special colors such as gold and silver in the image forming apparatus according to each embodiment, for example. CMY and T (special color, chromatic color) toner or six color toner may be used in the image forming apparatus according to each embodiment. Color printing (fusion of four toner layers) and monochrome printing (fusion of one color toner layers) may alternately be implemented in the image forming apparatus according to each embodiment. Continuous supply of sheets having different widths from each other may be implemented in the image forming apparatus according to each embodiment.

(C-3) When a length of the used medium is shorter than L, the variation of the target temperature range may start as the leading edge of the medium contacts the fuser unit in the image forming apparatus according to each embodiment.

(C-4) In each embodiment, the target temperature range that corresponds to the preceding medium is higher in comparison with the target temperature range that corresponds to the following medium in the image forming apparatus. The following effect and the like that are same as each embodiment are archived: the wait time period in which the surface temperature of the fuser belt ranges within the target temperature range is shorten even when the target temperature range that corresponds to the preceding medium is lower in comparison with the target temperature range that corresponds to the following medium in the image forming apparatus. It is needless to say that the target temperature range is not varied even when the medium reaches a predetermined position when the target temperature range that corresponds to the preceding medium is equal to the target temperature range that corresponds to the following medium.

Figure 12:
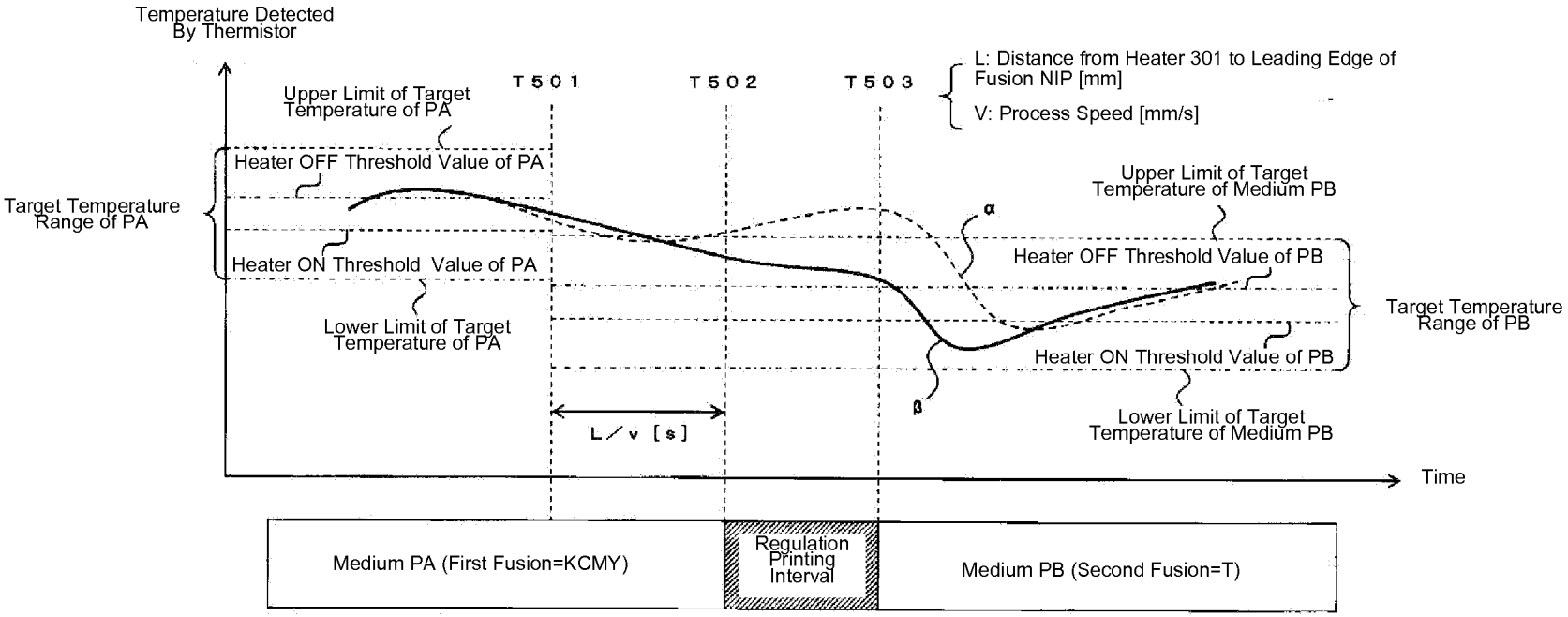
FIG. 12 is a timing chart of an operation example of the fuser control part according to a modification of the first embodiment that controls the heater control part.

(C-5) In each embodiment, the target temperature range is gradually varied with the predetermined incline ΔT. However, the target temperature range may be rapidly varied to the target temperature range that corresponds to the following medium within the range of the timing in which the detection temperature detected by thermistor 307 does not departs from the target temperature range of the preceding medium when a fuser unit having a large thermal capacity (the surface temperature poorly rises and descends in response to a heat quality added by a heater) is used, for example (see FIG. 12).

(C-6) In each embodiment, the endless fuser belt is used as a fuser member. However, the shape of the fuser member is not limited to a belt. A roller shaped fuser roller may be used, for example. A heater as a heat application member (e.g. halogen heater and the like) may be arranged in the fuser roller as the fuser member, and the target temperature range may be varied at the predetermined timing in which a preceding medium passes the fuser unit 131 (during the fusion process), for example. In each embodiment, one fuser belt is used as the fuser member. However, both of the fuser belt and the fuser roller may be used, for example.

(C-7) In each embodiment, the following example is explained: the fuser device according to the present invention is mounted on the image forming apparatus. However, the fuser device my only be configured as a sole device. The fuser control part and fuser unit according to each embodiment may only be extracted and configured as a sole device, for example.

What is claimed is:

1. An image forming apparatus, comprising:

an image forming part configured to form a developer image on a recording medium;

a fuser part that includes a fuser member and a heat application member and that is configured to fix the developer image on the recording medium;

a heat application control part configured to control the heat application member so that a temperature of the fuser member falls within a target temperature range that has been set; and a temperature setting part configured to set a first target temperature range and a second target temperature range, the first target temperature range being a target temperature range for a first fusion that is performed on a first recording medium, the second target temperature range being another target temperature range for a second fusion that is performed on a second recording medium, wherein the temperature setting part performs a target temperature range variation process to adjust the target temperature range to approach the second target temperature range from the first target temperature range during a fusion process of the first recording medium by the fuser member.

2. The image forming apparatus according to claim 1, wherein the image forming part forms a second developer image on the second recording medium after forming a first developer image on the first recording medium, the first developer image is made in a plurality of colors, the second developer image is made in a single color.

3. The image forming apparatus according to claim 2, wherein the first developer image is chromatic and the second developer image is transparent.

4. The image forming apparatus according to claim 2, wherein the first developer image is chromatic and the second developer image is a white developer image.

5. The image forming apparatus according to claim 1, wherein the temperature setting part performs a temperature control using a temperature variation incline that indicates an incline of a temperature variation per unit time when the temperature setting part shifts the first target temperature range to the second target temperature range.

6. The image forming apparatus according to claim 1, wherein the temperature setting part performs the target temperature range variation process to cause the temperature of the fuser member to approach the second target temperature range while the first fusion is performed on the first recording medium.

7. The image forming apparatus according to claim 1, further comprising:

a fuser member drive part that drives and rotates the fuser member, wherein the heat application member is in contact with a part of the fuser member and applies heat to the fuser member, and the fuser member is a nipping part formed of the driving and rotating fuser member, and performs a fusion process on the recording medium, and the temperature setting part starts the target temperature range variation process at a timing, during a process of the first fusion of the recording medium, at which a distance between a leading edge of the nipping part and a trailing edge of the first recording medium becomes equal to a distance between a part that is in contact with the heat application member on a surface of the fuser member and the leading edge of the nipping part.

8. The image forming apparatus according to claim 1, further comprising:

a fuser member drive part that drives and rotates the fuser member, wherein the heat application member is in contact with a part of the fuser member and applies heat to the fuser member, and the fuser member is a nipping part formed of the driving and rotating fuser member, and performs a fusion process on the recording medium, and the temperature setting part starts the target temperature range variation process, when the temperature of the fuser member becomes equal to a threshold value or higher during the process of the first fusion of the first recording medium, at a timing at which a distance between the leading edge of the nipping part and the trailing edge of the first recording medium becomes equal to a predetermined distance.

9. The image forming apparatus according to claim 1, wherein the first target temperature range is the target temperature range for the first fusion that is performed on a first surface of the first recording medium, and the second target temperature range is the target temperature range for the second fusion that is performed on a second surface of the second recording medium.

10. The image forming apparatus according to claim 1, wherein the first target temperature range is higher than the second target temperature range.

11. The image forming apparatus according to claim 10, wherein during the target temperature range variation process, an upper limit of the first target temperature range is gradually changed so that the upper limit of the first target temperature range becomes closer to an upper limit of the second target temperature range while a lower limit of the first target temperature range is maintained constant.

12. The image forming apparatus according to claim 1, wherein a lower limit of the first target temperature range is lower than an upper limit of the second target temperature range.

13. The image forming apparatus according to claim 1, wherein the first target temperature range is lower than the second target temperature range.

14. The image forming apparatus according to claim 13, wherein during the target temperature range variation process, a lower limit of the first target temperature range is gradually changed so that the lower limit of the first target temperature range becomes closer to a lower limit of the second target temperature range while an upper limit of the first target temperature range is maintained constant.

15. The image forming apparatus according to claim 1, wherein a lower limit of the first target temperature range is higher than an upper limit of the second target temperature range.

16. The image forming apparatus according to claim 1, wherein temperature thresholds to turn on and off the heat application member in the first target temperature range are higher than temperature thresholds to turn on and off the heat application member in the second target temperature range.

17. The image forming apparatus according to claim 1, further comprising:

a fuser member drive part that drives and rotates the fuser member, wherein the heat application member is in contact with a part of the fuser member and applies heat to the fuser member, and the fuser member is a nipping part formed of the driving and rotating fuser member, and performs a fusion process on the recording medium, and the temperature setting part starts the target temperature range variation process, when the temperature of the fuser member becomes equal to a threshold value or higher during the process of the first fusion of the first recording medium, at a timing at which a distance between a leading edge of the nipping part and a trailing edge of a first surface of the first recording medium becomes equal to a distance between a part that is in contact with the heat application member on a surface of the fuser member and the leading edge of the nipping part.

18. An image forming apparatus, comprising:

an image forming part configured to form a single color developer image and a multi-color developer image on a recording medium;

a fuser part that includes a fuser member and a heat application member and is configured to fix the single color developer image and the multi-color developer image on the recording medium;

a heat application control part configured to control the heat application member so that a temperature of the fuser member falls within a target temperature range that has been set; and a temperature setting part configured to set a first target temperature range and a second target temperature range when the single color developer image and the multi-color developer image are layered, the first target temperature range being a target temperature range for a fusion of the multi-color developer image formed on the recording medium, the second target temperature range being another target temperature range for a fusion of the single color developer image formed on the recording medium, wherein the temperature setting part performs a target temperature range variation process to adjust the target temperature range to approach the second target temperature range from the first target temperature range during a fusion process of the recording medium by the fuser member.

19. The image forming apparatus according to claim 18, wherein the image forming part forms the single color developer image after forming the multi-color developer image.

20. The image forming apparatus according to claim 19, wherein the single color developer image is a transparent developer image.

21. The image forming apparatus according to claim 19, wherein the single color developer image is a white developer image.

22. The image forming apparatus according to claim 18, wherein the first target temperature range is higher than the second target temperature range.

23. The image forming apparatus according to claim 22, wherein during the target temperature range variation process, an upper limit of the target temperature range is gradually changed so that the upper limit of the target temperature range becomes closer to an upper limit of the second target temperature range while a lower limit of the first target temperature range is maintained constant.

24. The image forming apparatus according to claim 18, wherein a lower limit of the first target temperature range is lower than an upper limit of the second target temperature range.

25. The image forming apparatus according to claim 18, wherein the first target temperature range is lower than the second target temperature range.

26. The image forming apparatus according to claim 25, wherein during the target temperature range variation process, a lower limit of the target temperature range is gradually changed so that the lower limit of the target temperature range becomes closer to a lower limit of the second target temperature range while an upper limit of the first target temperature range is maintained constant.

27. The image forming apparatus according to claim 18, wherein a lower limit of the first target temperature range is higher than an upper limit of the second target temperature range.

28. The image forming apparatus according to claim 18, wherein temperature thresholds to turn on and off the heat application member in the first target temperature range are higher than temperature thresholds to turn on and off the heat application member in the second target temperature range.

29. The image forming apparatus according to claim 18, further comprising:

a fuser member drive part that drives and rotates the fuser member, wherein the heat application member is in contact with a part of the fuser member and applies heat to the fuser member, and the fuser member is a nipping part formed of the driving and rotating fuser member, and performs the fusion process on the recording medium, and the temperature setting part starts the target temperature range variation process, when the temperature of the fuser member becomes equal to a threshold value or higher during the fusion of the multi-color developer image, before a timing at which a distance between a leading edge of the nipping part and a trailing edge of a surface of the recording medium becomes equal to a distance between a part that is in contact with the heat application member on a surface of the fuser member and the leading edge of the nipping part.

* * * * *